US010160097B2

(12) United States Patent
Krause et al.

(10) Patent No.: US 10,160,097 B2
(45) Date of Patent: Dec. 25, 2018

(54) DOUBLE-SIDED BUFFING PADS WITH INTERTWINED SEAMS

(71) Applicant: 3M INNOVATIVE PROPERTIES COMPANY, St. Paul, MN (US)

(72) Inventors: Aaron C. Krause, Voorhees, NJ (US); Aleksandrs Titovs, Olaine (LV)

(73) Assignee: 3M Innovative Properties Company, St. Paul, MN (US)

( * ) Notice: Subject to any disclaimer, the term of this patent is extended or adjusted under 35 U.S.C. 154(b) by 226 days.

(21) Appl. No.: 15/114,227

(22) PCT Filed: Jan. 29, 2015

(86) PCT No.: PCT/US2015/013477

§ 371 (c)(1),
(2) Date: Jul. 26, 2016

(87) PCT Pub. No.: WO2015/119826

PCT Pub. Date: Aug. 13, 2015

(65) Prior Publication Data

US 2017/0001283 A1 Jan. 5, 2017

Related U.S. Application Data

(60) Provisional application No. 61/935,530, filed on Feb. 4, 2014.

(51) Int. Cl.

| | |
|---|---|
| ***B24D 13/14*** | (2006.01) |
| ***B24D 11/00*** | (2006.01) |
| ***B24D 13/12*** | (2006.01) |

(52) U.S. Cl.
CPC ..... *B24D 13/147* (2013.01); *B24D 11/003* (2013.01); *B24D 13/12* (2013.01)

(58) Field of Classification Search
CPC ..... B24D 13/00; B24D 13/147; B24D 13/12; B24D 11/003
See application file for complete search history.

(56) References Cited

U.S. PATENT DOCUMENTS 1,998,244 A * 4/1935 Lang ..... A47L 11/164 15/230
2,100,340 A 2/1937 Lippitt
(Continued)

FOREIGN PATENT DOCUMENTS

| | | |
|---|---|---|
| CN | 203357224 U | 12/2013 |
| EP | 1702714 | 9/2006 |
| RU | 23269 U1 | 6/2002 |

OTHER PUBLICATIONS

International Search Report for PCT International Application No. PCT/US2015/013477, dated Jun. 11, 2015, 3 pages.

*Primary Examiner* — Timothy V Eley

(57) ABSTRACT

Provided are buffing pads that have intertwined seams such that any hard or unyielding edges are covered and not exposed during a buffing or polishing process. A double-sided buffing pad for polishing surfaces comprises a backing plate; two fibrous buffing media with filaments of textiles extending therefrom that are affixed one media to each face of the backing plate; and a seam that is intertwined by a portion of the filaments from each media are intertwined. The filaments may be intertwined by needle-tacking, air entanglement, or hydro-entanglement.

13 Claims, 2 Drawing Sheets

(56) References Cited

U.S. PATENT DOCUMENTS

| | | | | | |
|---|---|---|---|---|---|
| 3,413,674 | A | * | 12/1968 | Reid | A47L 13/316 15/230.12 |
| 3,990,124 | A | * | 11/1976 | MacKay, Jr. | B24D 13/00 15/230.12 |
| 4,580,308 | A | | 4/1986 | Ashworth | |
| 4,607,412 | A | | 8/1986 | Ashworth | |
| 5,249,329 | A | * | 10/1993 | Arnold | B24D 9/085 15/230 |
| 9,415,483 | B2 | * | 8/2016 | Krause | B24D 13/20 |
| 2002/0142712 | A1 | * | 10/2002 | Kaiser | B24B 29/02 451/442 |
| 2007/0298697 | A1 | | 12/2007 | Charmoille et al. | |
| 2012/0052780 | A1 | | 3/2012 | Krause et al. | |
| 2012/0064809 | A1 | | 3/2012 | Krause et al. | |

* cited by examiner

DOUBLE-SIDED BUFFING PADS WITH INTERTWINED SEAMS

CROSS REFERENCE TO RELATED APPLICATIONS

This application is a national stage filing under 35 U.S.C. 371 of PCT/US2015/013477, filed Jan. 29, 2015, which claims the benefit of U.S. Provisional Application No. 61/935,530, filed Feb. 4, 2014, the disclosures of which are incorporated by reference in their entireties herein.

FIELD

The present invention relates to a double-sided buffing pad for use with a rotary buffing machine for high speed polishing of automobiles, boats, planes, furniture, marble and other surfaces and more particularly, toward a double-sided buffing pad with wool or other natural or synthetic fibers.

BACKGROUND

Buffing pads for use in high speed polishing of automobiles and the like may be one-sided or two-sided. A one-sided buffing pad is typically circular and comprises a buffing medium (e.g., foam, wool, etc.) attached to one face of a backing plate, usually rigid, which is attached by a central hub to the drive shaft or spindle of a motor for a rotary tool, such as a power buffer. The buffing medium may be permanently attached to the backing plate or releasably attached thereto in order to allow for replacement without disposing of the backing plate. A two-sided or double-sided buffing pad includes buffing medium attached to each face of a rigid backing plate. The plate includes a hub for releasably attaching the buffing pad to the drive shaft or spindle of the motor. The pad may be attached to the drive shaft or spindle of the motor from either side of the buffing pad, thereby allowing the pad to be reversed after one side has been used.

Buffing pads are formed with fibrous buffing media that are generally provided as circular layers of material sometimes also referred to as "flats" in the industry. The flats provide a buffing surface of fibers and a base structure for securing the fibers. Typically, the edge or perimeter of the base structure is hard and/or unyielding. Also, it is the base structure that is glued or adhered to the backing plate of the entire assembly. Usually, glue or adhesive is located short of or within the edge or perimeter so that it does not go beyond the base structure. For tufted flats, the base structure may be a scrim, rigid or semi-rigid material, which receives and secures tufted fibers such as wool. For knitted flats, staple fibers of a desired textile such as cotton are knitted to form an integral backing, which is usually stiff, from which the fibers extend.

There is a continuing need to provide buffing pads, specifically, double-sided buffing pads that are efficient and effective.

SUMMARY

Due to the presence of a hard and unyielding component and glue in a buffing pad, there is a potential for scuffing and/or marring of a surface should the buffing pad tilt towards the surface of a substrate being buffed in a way that exposes the edge of the hard or unyielding material or glue. Provided are buffing pads that have intertwined seams such that any hard or unyielding edges are covered and not exposed during a buffing or polishing process.

A first aspect provides a double-sided buffing pad for polishing surfaces comprising: a backing plate; two fibrous buffing media with filaments of textiles extending therefrom that are affixed one media to each face of the backing plate; and a seam that is intertwined by a portion of the filaments from each media. The filaments may be intertwined by needle-tacking, air entanglement, or hydro-entanglement. The seam covers edges of the buffing media.

The fibrous buffing media may comprise knitted staple fibers such that the filaments of textiles extend from an integrally-knitted backing. Or, the fibrous buffing media comprise fibers tufted into a scrim from which the filaments of textiles extend. The textiles may comprise wool, acrylic, rayon, nylon, polyester, mohair, and/or cotton.

The double-sided buffing pad may further comprising a central opening defined by a hub that operatively attaches to a rotary tool upon assembly. In a detailed embodiment, the pad further comprises two blocks of material located between the buffing media and the hub, wherein the blocks of material each have an aperture therethrough in alignment with the central opening.

Another aspect provides methods of making a double-sided buffing pad for polishing surfaces, the methods comprising: affixing two fibrous buffing media with filaments of textiles extending therefrom to a backing plate, one media to each face of the backing plate; and forming a seam by intertwining a portion of the filaments of textiles from each media. Intertwining may be achieved by needle-tacking, air entanglement, or hydro-entanglement.

Another aspect provides a method of polishing a surface of a substrate, the method comprising: obtaining any double-sided buffing pad provided herein; and contacting the surface with a surface of double-sided buffing pad.

BRIEF DESCRIPTION OF THE DRAWINGS

The accompanying drawings are included to provide a further understanding of the invention described herein and are incorporated in and constitute a part of this specification. The drawings illustrate exemplary embodiments. Certain features may be better understood by reference to the following detailed description when considered in connection with the accompanying drawings, in which like reference numerals designate like parts throughout the figures thereof, and wherein.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

Figure 1:
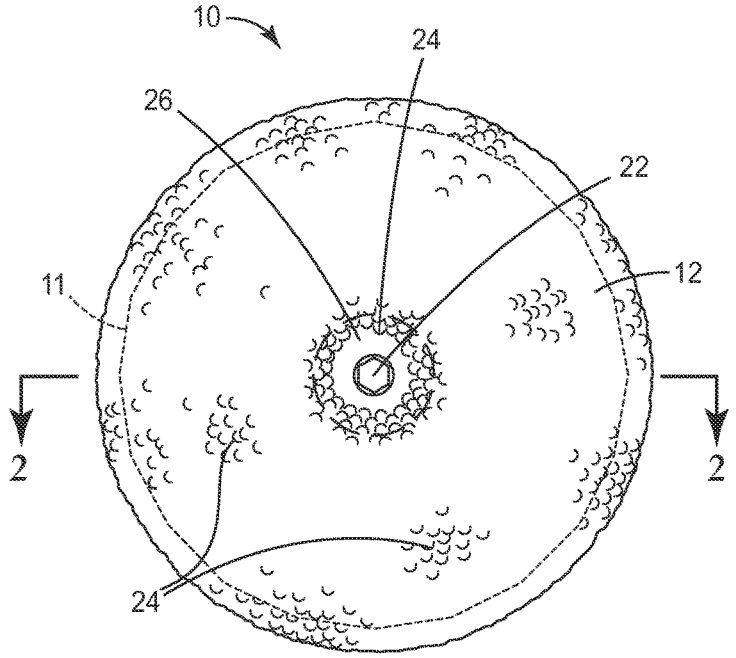
FIG. 1 is a top elevational view of a double-sided buffing pad according to an embodiment of the invention.

Provided are double-sided buffing pads having intertwined seams that inhibit an edge and/or any glue of the buffing media or flat from contacting a surface being buffed or polished. Such pads are also aesthetically appealing. Reference to a "seam" means the location where two parts of a whole come together. Here, the seam is formed between two fibrous buffing media or flats. By "intertwined" it is meant that filaments of textiles are physically entangled such that there is no gap between the two fibrous buffing media or flats. Methods of intertwining include: needle-tacking, air entanglement, or hydro-entanglement. Thus, inventive double-sided buffing pads may be formed from traditional buffing pads with the additional step of forming an intertwined seam. Once the seam is formed, the filaments may be combed for further improved feel and performance.

Suitable textiles are natural, synthetic, and combinations thereof. Exemplary textiles include but are not limited to wool, acrylic, rayon, nylon, polyester, mohair, and/or cotton. The textiles may be knitted or tufted.

For needle-tacking, an outer periphery of an unseamed double-sided buffing pad is placed on a working surface and under a plurality of needles, each of which carries a plurality of downwardly extending barbs. The outer periphery comprises a portion of filaments of textiles of the buffing media. Such needles and barbs are, per se, well known and are used to produce what is commonly referred to as needle punched felt and similar materials. A preferred device comprises five felting needles which have barbs on a triangular shaft which are facing down in one direction. As the needles are moved downwardly through the outer periphery, the barbs catch a plurality of filaments and draw them downwardly so that the filaments become intertwined with the filaments below. After the needles are raised, the buffing pad is rotated or shifted and the needles are then again moved downwardly to intertwine additional filaments. This process can be repeated as many times as desired in order to increase the density of intertwined filaments. Number of needles, the speed of movement of the buffing pad under the needles, and the frequency of the up and down strokes of the needles all impact the extent of intertwining and durability of the seam.

For air entanglement, the outer periphery would be exposed to an air jet, such that a perpendicular or nearly perpendicular high pressure air stream is applied to the area. The air stream creates a force that entwines individual filaments together, which creates a kind of braiding effect. Cohesion is then provided between the filaments.

For hydro-entanglement, the outer periphery would be exposed to high-speed jets of water to entangle the filaments so that they knot around one another thereby forming an intertwined seam.

Regarding the fibrous buffing media or flats, as is well known in the art, the lengths of the individual filaments 24 making up the layer 12 are substantially equal and have a length sufficient to provide the pad with its ability to buff the surface of an automobile or the like.

As to the backing plate, an exemplary structure is provided in commonly-assigned U.S. Patent Appln. No. 20120052780.

As to the double-sided buffing pads, they are generally given nominal outer diameter (OD) sizes in the range of 2-9 inches (5-23 cm). The backing plates may have outer diameters in the range of 1-8 inches (2.5-20 cm) and inner diameters in the range of 0.25-1.5 inches (0.6-2.8 cm). The knap of the fibrous buffing media or flats may have a thickness in the range of 1-2 inches (2.5-5 cm). The filaments should be long enough to permit intertwining.

Before describing several exemplary embodiments of the invention, it is to be understood that the invention is not limited to the details of construction or process steps set forth in the following description. The invention is capable of other embodiments and of being practiced or being carried out in various ways.

Figure 2:
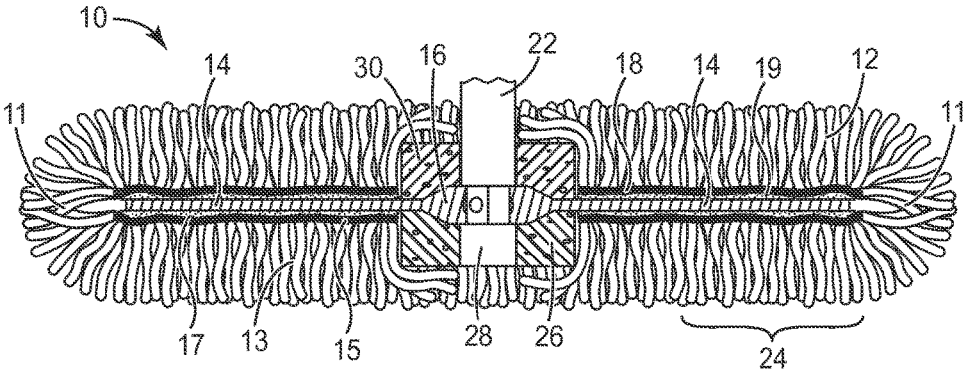
FIG. 2 is a cross-sectional view taken through the line 2-2 of FIG. 1.

Turning to the figures, FIG. 1 is a top elevational view and FIG. 2 is a cross-sectional view of a double-sided buffing pad according to an embodiment of the invention, where the buffing pad 10 having an intertwined seam 11 is particularly useful for buffing or polishing an automobile and essentially includes circular layers 12, 13 of fibrous buffing media, which may also be referred to as a flat, including filaments 24 of textiles such as, tufted wool or knitted cotton, where a portion of the filaments 24 are intertwined to form a seam 11. Base structures 18, 15 of circular layers 12, 13, respectively, secure fibers or filaments 24. The base structures 18, 15 are secured to a backing plate 14 which includes a central hub 16 having an axial opening for attachment via a quick connector 22 to the drive shaft or spindle of a power tool. Optional blocks of material 26, 30, such as foam and as disclosed on commonly-assigned U.S. Patent Appln. Pub. No. 20120064809, may be centrally located to inhibit the filaments from interfering with functioning of the quick connect 22. Aperture 28 of block 26 is in alignment with an opening of central hub 16. In the cross-section view of FIG. 2, the presence of a layer of adhesive or glue 17, 19 is shown between each base structure 15, 18, respectively, and the backing plate 14. It is noted that the layer of adhesive or glue 19, 17 does not extend beyond the base structure 18, 15 of the circular layers 12, 13.

Figure 3:
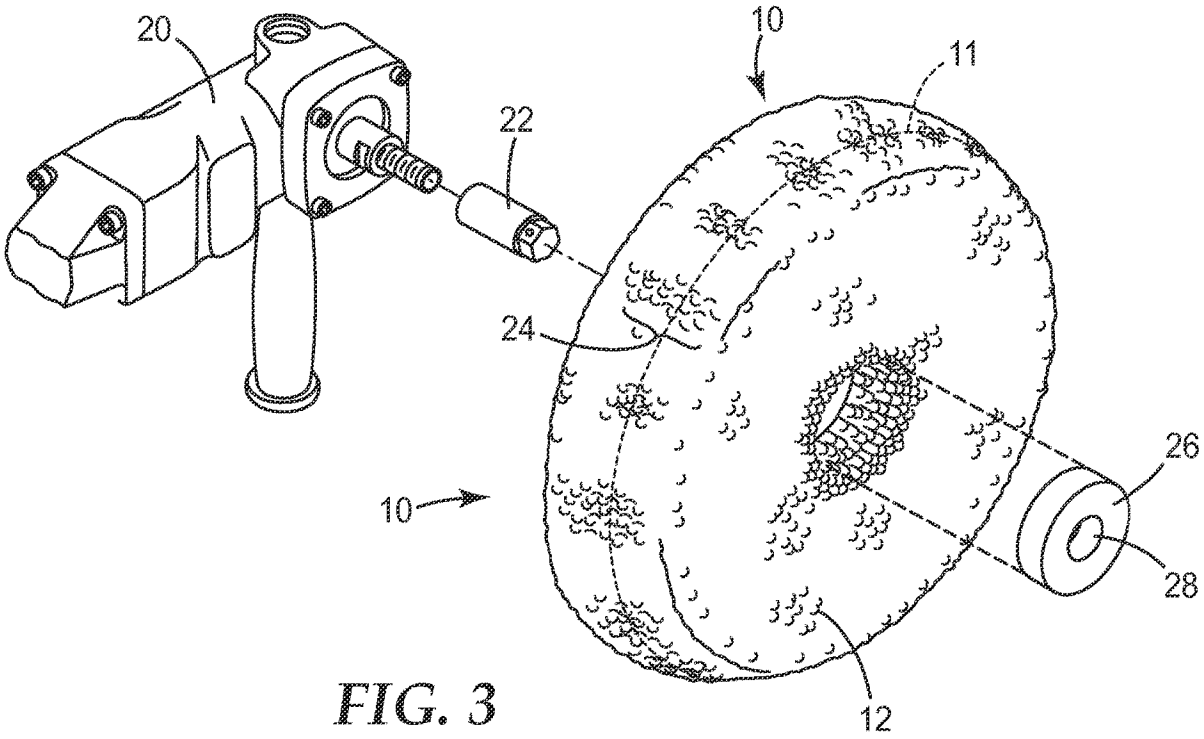
FIG. 3 is a front perspective of an embodiment of a double-sided buffing pad of the invention and about to be secured to a quick connector for attachment to a rotary tool such as a power buffer and showing portions of the buffing pad, connector and power buffer partially exploded.

In FIG. 3, it is shown that buffing pad 10 may be secured to rotary power buffer 20 through the use of a quick connector 22. The circular layer 12 of buffing medium is comprised of a plurality of filaments 24 of textiles that extend outwardly from the inner surface of the layer which is attached to the backing plate 14. A portion of the filaments 24 are intertwined for form seam 11. The optional block 26 with aperture 28 is centrally located. While the invention has been illustrated with a quick connector for attaching the buffing pad to a power buffer, other modes of attachment may be used. For example, axial opening in hub 16 may be shaped, e.g. hexagonally, or threaded for threaded attachment to the drive shaft or spindle of a power buffer. Connectors may be magnetic as well. Furthermore, while the blocks 26 and 30 are preferably made from foam, other natural or synthetic materials may be used. For example, the blocks may be made of felt, materials used in washers and gaskets, or the like so long as the blocks are able to prevent the fibrous buffing media from entering the center opening in the buffing pad while, at the same time, not themselves interfere with the ability to connect the buffing pad to the power buffer.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments. The order of description of the above method should not be considered limiting, and methods may use the described operations out of order or with omissions or additions.

It is to be understood that the above description is intended to be illustrative, and not restrictive. Many other embodiments will be apparent to those of ordinary skill in the art upon reviewing the above description. The scope of the invention should, therefore, be determined with reference to the appended claims, along with the full scope of equivalents to which such claims are entitled.

What is claimed is:

1. A double-sided buffing pad for polishing surfaces comprising:

a backing plate;

two fibrous buffing media, each comprising a base structure and filaments of textiles extending therefrom, wherein one media is affixed to each face of the backing plate; and a seam comprising intertwined filaments from both media.

2. The double-sided buffing pad of claim 1, wherein the filaments are intertwined by needle-tacking, air entanglement, or hydro-entanglement.

3. The double-sided buffing pad of claim 1, wherein the seam covers edges of the buffing media.

4. The double-sided buffing pad of claim 1, wherein the seam is effective to inhibit exposure of edges of the fibrous buffing media during use.

5. The double-sided buffing pad of claim 1, wherein the fibrous buffing media comprise knitted staple fibers such that the filaments of textiles extend from an integrally-knitted base structure.

6. The double-sided buffing pad of claim 1, wherein the fibrous buffing media comprise fibers tufted into a scrim from which the filaments of textiles extend.

7. The double-sided buffing pad of claim 1, wherein the textiles comprise wool, acrylic, rayon, nylon, polyester, mohair, and/or cotton.

8. The double-sided buffing pad of claim 1 further comprising a central opening defined by a hub that operatively attaches to a rotary tool upon assembly.

9. The double-sided buffing pad of claim 8 further comprising two blocks of material located between the buffing media and the hub, wherein the blocks of material each have an aperture therethrough in alignment with the central opening.

10. A method of polishing a surface of a substrate, the method comprising:

obtaining the double-sided buffing pad of claim 1; and contacting the surface with a surface of the double-sided buffing pad.

11. A method of making a double-sided buffing pad for polishing surfaces, the method comprising:

affixing two fibrous buffing media, each comprising a base structure and filaments of textiles extending therefrom, to a backing plate, where one media is affixed to each face of the backing plate; and forming a seam by intertwining a portion of the filaments of textiles from each media.

12. The method of claim 11, wherein the filaments are intertwined by needle-tacking, air entanglement, or hydro-entanglement.

13. The method of claim 11 further comprising combing the seam.

* * * * *